US005828766A

United States Patent [19]

Gallo

[11] Patent Number: 5,828,766

[45] Date of Patent: Oct. 27, 1998

[54] ACOUSTIC SPEAKER SYSTEM

[75] Inventor: Anthony Gallo, Brooklyn, N.Y.

[73] Assignee: Anthony Gallo Acoustics, Inc., Brooklyn, N.Y.

[21] Appl. No.: 897,376

[22] Filed: Jul. 21, 1997

Related U.S. Application Data

[63] Continuation of Ser. No. 356,938, Dec. 15, 1994, abandoned.

[51] Int. Cl.[6] ..... H04R 25/00

[52] U.S. Cl. ..... 381/190; 381/182; 381/332

[58] Field of Search ..... 381/332, 188, 381/205, 86, 190, 182, 186, 173

[56] References Cited

U.S. PATENT DOCUMENTS

| | | | |
|---|---|---|---|
| 3,832,580 | 8/1974 | Yamamuro et al. | 381/190 |
| 3,835,256 | 9/1974 | Wieder | 381/86 |
| 4,331,841 | 5/1982 | Castagna | 381/205 |
| 4,486,868 | 12/1984 | Kodera et al. | 367/140 |
| 4,554,414 | 11/1985 | House | 381/182 |
| 4,591,668 | 5/1986 | Iwata | 381/151 |
| 4,761,817 | 8/1988 | Christie | 381/194 |
| 4,998,598 | 3/1991 | Mardian et al. | 181/284 |
| 5,010,943 | 4/1991 | Boyer | 160/351 |

*Primary Examiner*—Vivian Chang
*Attorney, Agent, or Firm*—Fish & Neave; Jeffrey H. Ingerman; Brett G. Alten

[57] ABSTRACT

An acoustic speaker system according to this invention is provided that includes a conventional woofer, an electro-acoustic converter that functions as a tweeter, and a system enclosure. The converter includes an electro-acoustic transducer and a variable density hollow body. The transducer includes a piezoelectric sheet and two conductive electrodes. One electrode is disposed on each face of the sheet. Coatings are optionally disposed on each side of the transducer. The transducer is wrapped around a variable density body which may be filled with an acoustic dampening material. The acoustic speaker system enclosure includes a hollow ellipsoidal woofer enclosure with a portion of its outer surface for mounting an electro-acoustic converter, and optionally, a converter cover. The acoustic speaker system also includes an elastomeric cover that is fastened to the dome portion of a woofer.

170 Claims, 9 Drawing Sheets

ACOUSTIC SPEAKER SYSTEM

This is a continuation of application Ser. No. 08/356,938, filed Dec. 15, 1994, entitled ACOUSTIC SPEAKER SYSTEM, now abandoned.

BACKGROUND OF THE INVENTION

This invention relates to acoustic speaker systems for converting electrical energy into acoustic energy with a fast transient response time, and more particularly to a system having a piezoelectric film tweeter.

Previously known speaker systems generally include two or more speaker elements, each of which converts electrical energy into acoustic energy over a particular frequency range. The conversion of electric energy into acoustic energy is limited by the mechanical constraints of each speaker. For example, in conventional electromagnetic speakers, an electrical current energizes an electromagnet that is fixed to a lightweight flexible surface, producing an electromagnetic field. This field interacts with another magnetic field produced by a permanent magnet fixed to a frame holding the flexible surface. During operation, the interaction between the fields produces a force which drives the surface to vibrate at the frequency of the electrical signal, thereby producing acoustic energy.

A significant disadvantage of conventional electromagnetic speakers, however, is the slow transient response time to high frequency signals. Due to the inherently large mass associated with magnetic components, these speakers are not able to quickly respond to an electrical signal. Neither are they able to quickly return to a neutral position after the transient signal has passed. Therefore, the slow transient response times of these components have caused acoustic engineers to seek alternatives.

In addition, the geometry of most electromagnetic speakers define preferred axes. For instance, it is well known that acoustic energy in most conventional speakers drops rapidly once off the principal axis of the speaker. Therefore, regions of space are established wherein a balanced frequency response is achieved. Outside of this preferred region, acoustic reproduction is not accurate.

Most conventional speaker systems contain more than one speaker—e.g., a woofer, a tweeter, and, optionally, a mid-range speaker—each speaker reproducing sound in a portion of the audible frequency spectrum. Normally, an active or passive electronic crossover circuit is required to distribute a single composite electrical signal to the individual speaker components of the system. The acoustic characteristics of each speaker component, however, vary significantly. Therefore, the electronic circuit must be carefully engineered to account for the specific acoustic characteristics of the speaker components and the speaker enclosure.

Another disadvantage of a conventional speaker system is its susceptibility to break-up distortion. This distortion is primarily due to a speaker's mechanical inability to maintain its entire vibrating surface in phase during operation and results in the production of extraneous and undesired acoustic output.

Furthermore, conventional box-like speaker system enclosures normally have a large number of resonant frequencies. During operation of the acoustic speaker system, the enclosure could undesirably alter the output of the speakers by re-radiating the speaker output at these resonant frequencies. The alteration is undesirable because it further reduces the accuracy of the acoustic reproduction of the electric signal.

Conventional flat-faced acoustic system enclosures have a variety of other disadvantages. Often, enclosures absorb acoustic energy during operation, and subsequently release it in the form of acoustic energy at different undesired frequencies, including, possibly, undesirable harmonics of desirable acoustic frequencies. Also, when the woofer, for example, is strongly acoustically coupled to the enclosure, resonances are generated easily. Furthermore, enclosures usually include covers that protect speaker components from physical damage. Because the acoustic output must pass through the protective covers, acoustically non-transparent covers undesirably alter the frequency response.

Another disadvantage of conventional speaker systems is the large physical size required to ensure a balanced and efficient low frequency response. The primary reason for using a large enclosure is to provide a sufficient volume of air against which a woofer can freely vibrate. Small enclosures, however, contain small volumes of air which restrict the vibratory motion of the woofer. Acoustic dampening materials such as fiberglass, wool, and synthetic polyester fibers (such as those sold under the trademark DACRON®, by E. I. du Pont de Nemours & Company, of Wilmington, Del.), are often used to diminish the enclosure size requirement. Unfortunately, however, because of these materials' low acoustic absorption, the use of these materials can not substantially reduce the size of the enclosure and simultaneously ensure a balanced low frequency response with a fast transient response time.

One alternative to a conventional electromagnetic speaker that has been tried is to use a piezoelectric transducer in a speaker. One previously known piezoelectric transducer employs a ceramic piezoelectric material. Ceramic piezoelectric devices, however, have several mechanical disadvantages during operation, including low conversion efficiency, significant mechanical resonances and complex construction requirements. It is also well known that the mechanical quality Q of many ceramic piezoelectric substances is high, making it difficult to obtain a broad-band frequency response.

Another previous attempt, using a non-ceramic piezoelectric transducer, is described in Yamamuro et al. U.S. Pat. No. 3,832,580, wherein the piezoelectric element is either a natural or synthetic high molecular weight polymeric substance in the form of a thin sheet. The polymeric substance is sandwiched between two electrodes deposited on each face of the sheet. When an electrical signal is applied to the electrodes, an electric field is produced in the sheet, temporarily reorienting polar molecules in the sheet. The microscopic reorientation of the molecules results in a macroscopic expansion or contraction in the plane of the sheet. If the sheet is deformed out of its original planar shape—e.g., into a convex shape—the macroscopic in-plane contraction and expansion will produce motion inward and outward, respectively, producing acoustic energy in the surrounding medium. Also, the high flexibility of the polymer produces a broader frequency response than the ceramic devices.

Known piezoelectric transducers of the type just described, however, have several disadvantages related to the geometry of the system. During operation, sound is produced on both faces of the transducer. Therefore, if the transducer is deformed out of its plane as it must be, each inside surface projects a backwave which destructively interferes with the performance of the opposing outside surface.

Furthermore, in the known piezoelectric transducer described above, the electrodes were thin metallic films. In addition to the low cost associated with certain metallic electrodes, they are fabricated safely and easily. For example, aluminum electrodes may be sputtered onto the surface of a piezoelectric sheet. However, metallic films have several disadvantages. First, the relatively high electrical resistance of a thin film results in a voltage drop across each electrode's surface. The magnitude of the voltage drop is proportional to the sheet resistance of the electrode as described by Ohm's Law. This drop causes several undesirable effects. First, the voltage reduction diminishes the transducer's ability to respond to high frequency electrical signals, resulting in high frequency roll-off. Because it is known that any audio component should ideally reproduce frequencies five times greater than the audible limit (e.g., 5×20 kHz=100 kHz), even minimal roll-off can severely reduce the overall performance of the system. The voltage reduction also causes different portions of the surface to vibrate out of phase, thereby creating self-interference effects. Another disadvantage of thin metallic films is their susceptibility to micro-cracking. Micro-cracking further increases the resistance of the film, exacerbating the voltage drop problem described above, and eventually rendering the transducer inoperable.

Also, metallic components of piezoelectric transducers may oxidize under certain atmospheric conditions. The oxidation is not only aesthetically unpleasing, but may reduce performance by altering the carefully engineered mass distribution of the transducer. Known transducers also perform differently in changing atmospheric conditions, because the capacitance between the two electrodes is dependent upon the atmospheric environment.

Yet another problem found in most conventional piezoelectric speakers is the accurate control of high frequencies. Although a highly conductive electrode is desired to overcome the high frequency roll-off discussed above, the overall output of the transducer must neither be augmented nor diminished, producing a balanced, or flat, response. Because of the mechanical and electrical constraints discussed above, conventional tweeters, however, do not readily accomplish this flat response.

It would therefore be desirable to be able to provide a speaker system that is physically small, operates without a crossover network, and produces a broad balanced response over the entire audible spectrum with a fast transient response time.

It would also be desirable to be able to provide a piezoelectric transducer with stabilized capacitance to accurately and quickly convert electrical signals into acoustic energy over a broad frequency range, distribute sound evenly over a broad angular range, eliminate self-interference, and minimize break-up distortion.

It would further be desirable to be able to provide a speaker enclosure that minimally alters the accuracy of the acoustic reproduction of electric signals by providing an improved acoustic dampening material and a reduced acoustic coupling between the woofer and the enclosure.

SUMMARY OF THE INVENTION

It is therefore an object of this invention to provide a speaker system that is physically small, operates without a crossover network, and produces a broad balanced response over the entire audible spectrum with a fast transient response time.

It is also an object of this invention to provide a piezoelectric transducer with a stabilized capacitance to accurately convert electrical signals into acoustic energy over a broad frequency range, distribute the sound evenly over a broad angular range, virtually eliminate self-interference, and minimize break-up distortion.

It is a further object of this invention to provide a speaker enclosure that minimally alters the accuracy of the acoustic reproduction of electric signals by providing an improved acoustic dampening material and a reduced acoustic coupling between the woofer and the enclosure.

In accordance with this invention, a speaker system is provided that has an electro-acoustic converter, a woofer, and a system enclosure that provides fast and accurate acoustic reproduction of electrical signals. The converter includes an electro-acoustic transducer and a hollow body. The transducer includes a piezoelectric sheet and two conductive electrodes. One electrode is disposed on each face of the sheet. The transducer is wrapped around a variable density body which may be filled with an acoustic dampening material. The acoustic speaker system enclosure includes a hollow ellipsoidal woofer enclosure with a portion of its outer surface for mounting an electro-acoustic converter, and optionally, a converter cover. The acoustic speaker system also includes an elastomeric cover that is fastened to the dome portion of a woofer.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
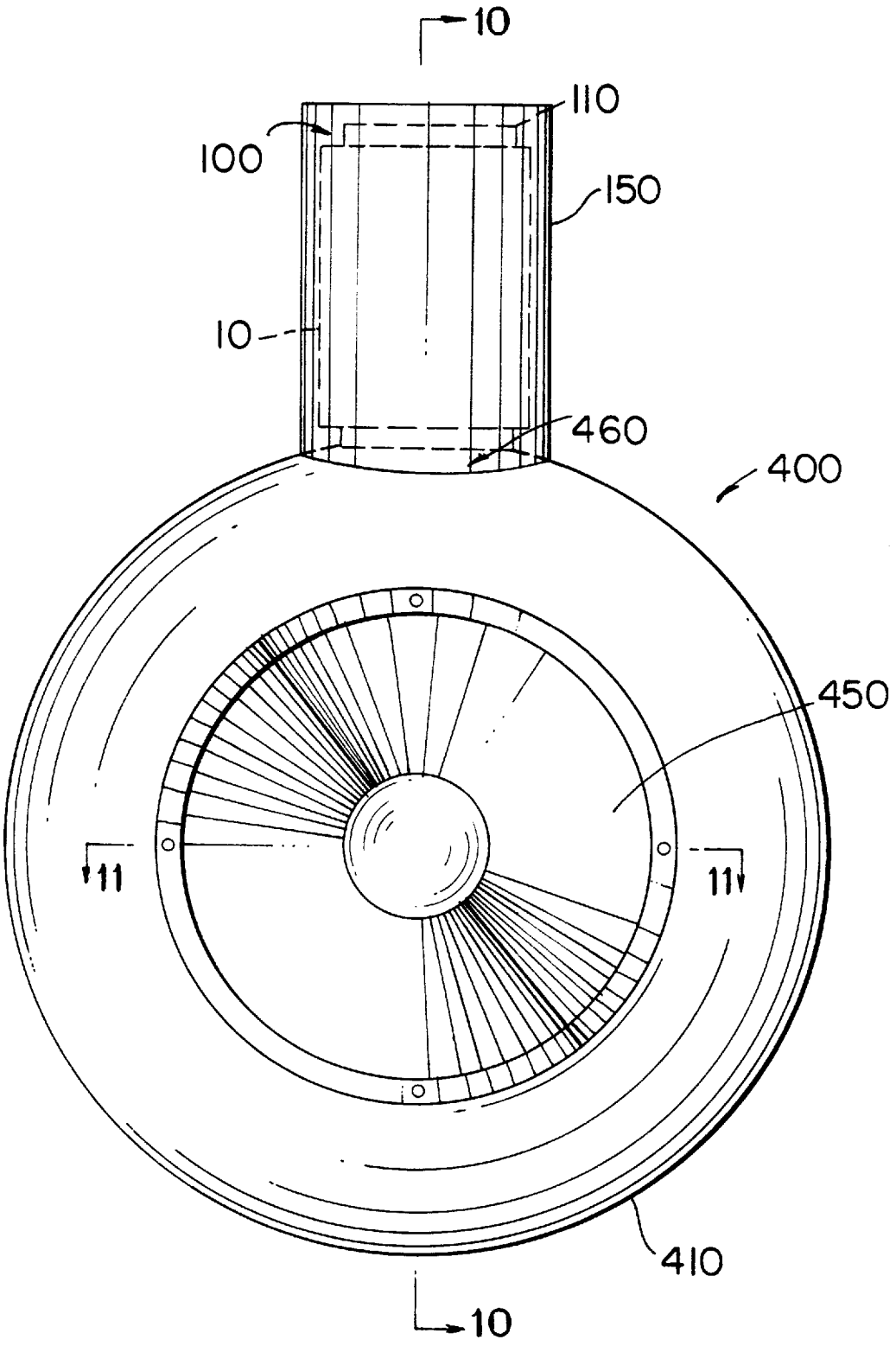
FIG. 1 is a front view of an acoustic speaker system according to the present invention.
Figure 2:
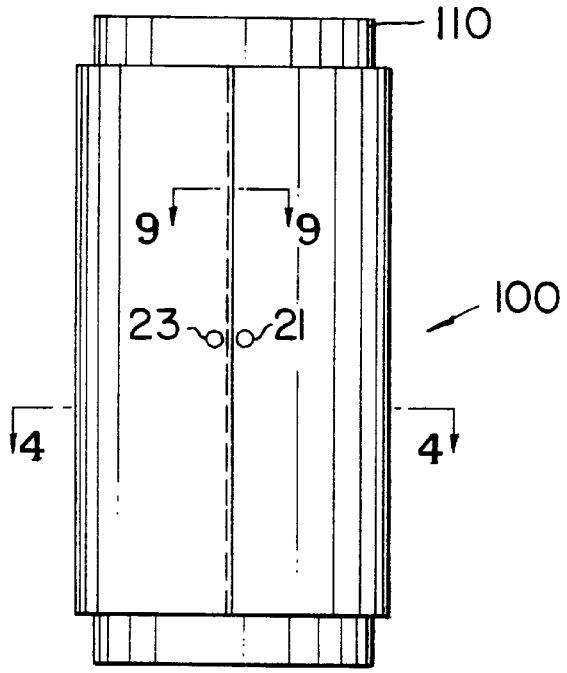
FIG. 2 is a back view of a cylindrical embodiment of an electro-acoustic converter according to the present invention.
Figure 3:
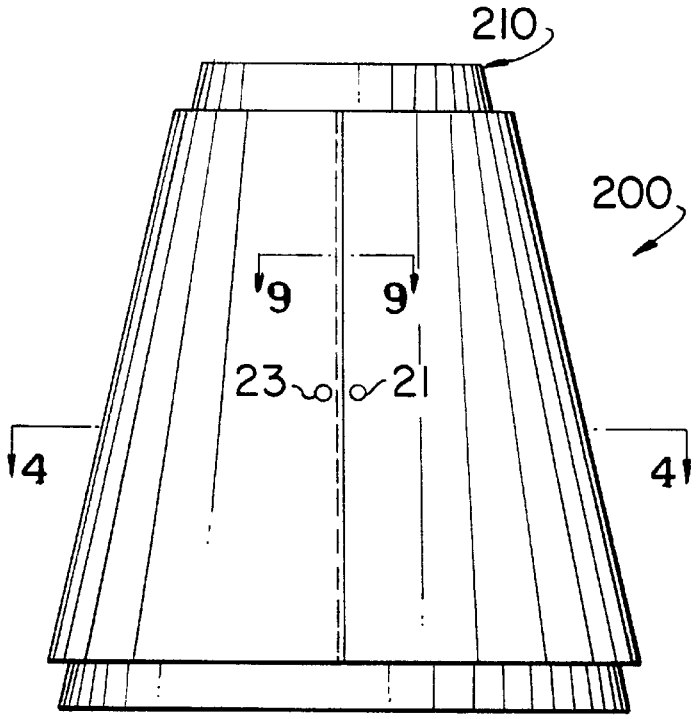
FIG. 3 is a back view of a frustoconic embodiment of an electro-acoustic converter according to the present invention.
Figure 4:
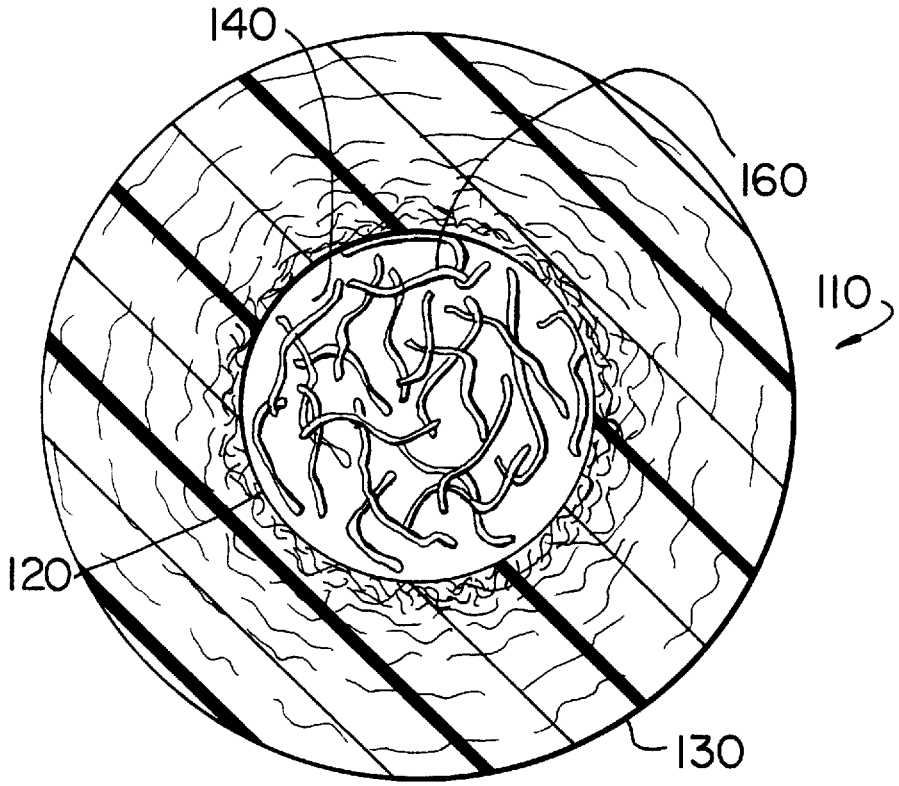
FIG. 4 is a cross-sectional view of the electro-acoustic converter body of FIG. 2 or FIG. 3, taken from line 4—4 of FIG. 2 or FIG. 3.
Figure 5:
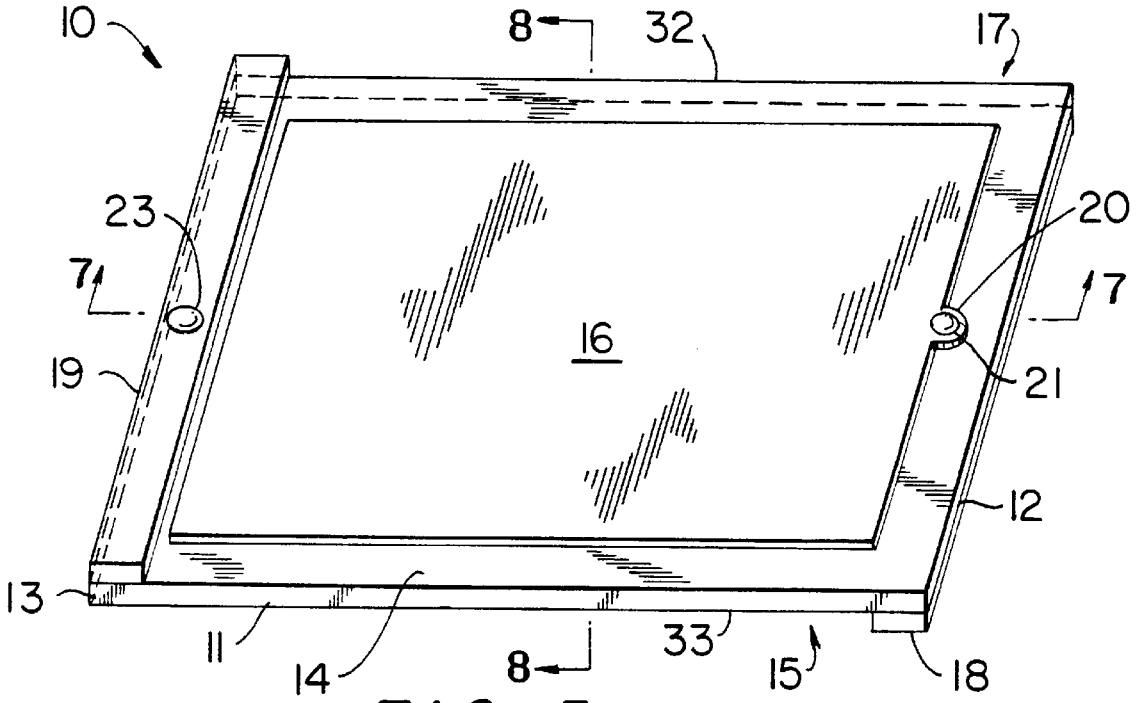
FIG. 5 is a perspective view of a rectangular piezoelectric transducer according to the present invention.
Figure 6:
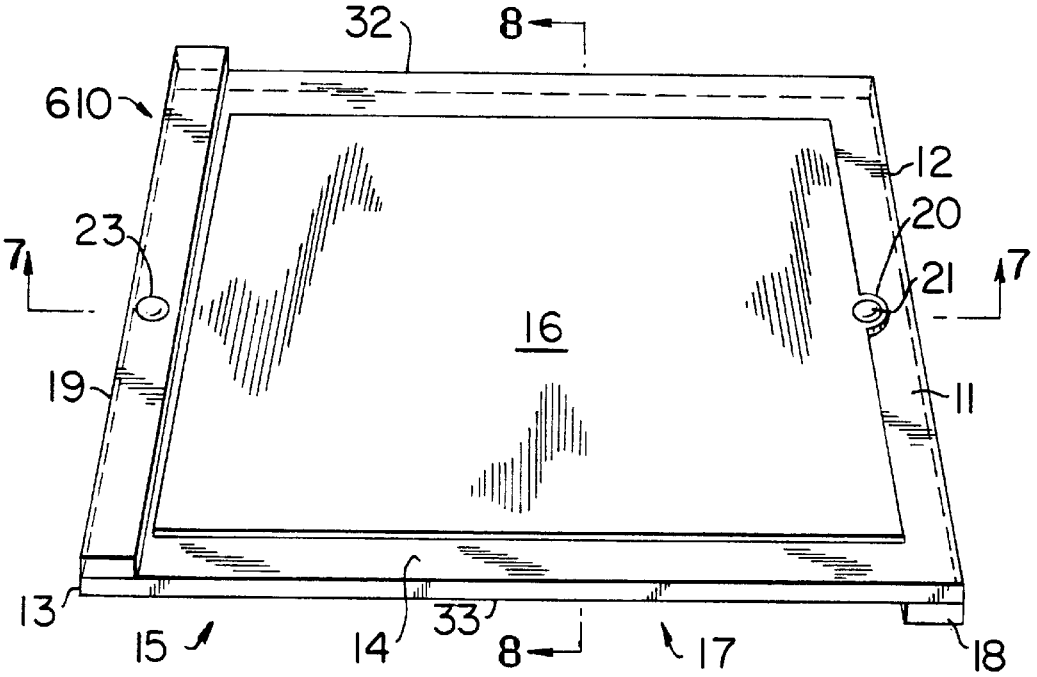
FIG. 6 is a perspective view of a trapezoidal piezoelectric transducer according to the present invention.
Figure 7:
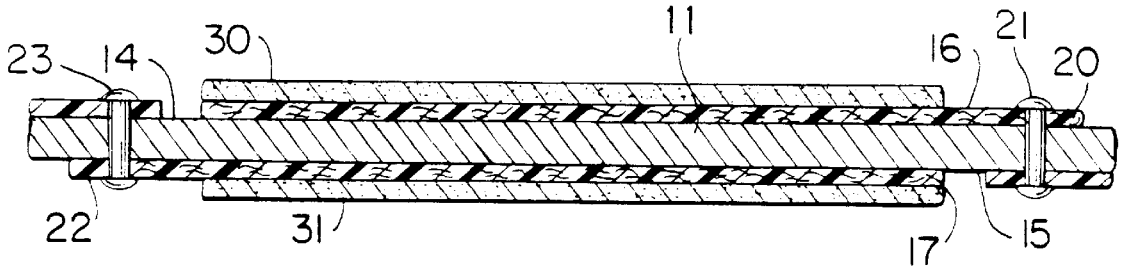
FIG. 7 is a cross-sectional view of the piezoelectric transducer of FIG. 5 or FIG. 6 taken from line 7—7 of FIG. 5 or FIG. 6, to which a coating has been added.
Figure 8:
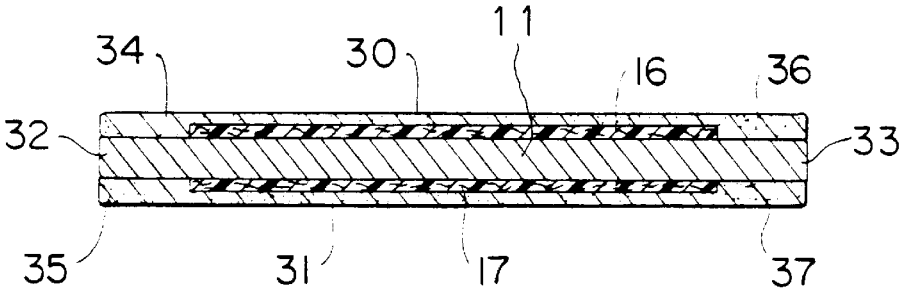
FIG. 8 is a cross-sectional view of the piezoelectric transducer of FIG. 5 or FIG. 6 taken from line 8—8 of FIG. 5 or FIG. 6, to which a coating has been added.

A speaker system according to this invention includes a conventional woofer, an electro-acoustic converter that functions as a tweeter that provides fast and accurate acoustic reproduction of electrical signals. The invention also includes a system enclosure.

The electro-acoustic converter preferably functions as a tweeter and therefore provides acoustic output in the upper portion of the audible frequency range. The converter includes an electro-acoustic transducer and a hollow body with a smooth outer surface. The transducer is preferably made from a piezoelectric sheet and two conductive electrodes. One electrode is disposed on most of one face of the sheet and the other electrode is disposed on most of the other face of the sheet. The transducer is disposed against a curved portion of the outer surface the body. The electrodes of the transducer are made from a flexible electrically conductive material, preferably silver dispersed in polyurethane. The electrodes end away from the sheet edge to avoid electrical arcing between electrodes on opposite sides of the sheet. The transducer preferably has at least one coating whose pattern and thickness are controlled to minimize undesirable acoustic phenomena such as break-up distortion and aberrant high frequency responses, and to protect the transducer from oxidation.

The mass density of the hollow body preferably continuously decreases toward its outer surface to provide a support system that avoids dampening any motion of the transducer during operation while absorbing backwaves to prevent interference effects. Preferably, the hollow body is filled with an acoustic dampening material, which is preferably ceramic fibers and most preferably alumina-silica ceramic fibers. The hollow feature reduces the acoustic coupling between opposing vibrating surfaces of the transducer and the dampening material further aids in this decoupling.

A speaker system enclosure provides support and protection for the above-mentioned tweeter, as well as a woofer. The system enclosure includes a hollow woofer enclosure that is preferably substantially ellipsoidal and has a woofer mounting hole. The outer surface preferably has a portion for mounting the electro-acoustic converter. Finally, an acoustically transparent converter cover can also be mounted around the converter.

The acoustic speaker system according to the invention also preferably includes an elastomeric cover that is fastened to the dome portion of the woofer to dampen pre-determined portions of the audible frequency range.

The heart of the electro-acoustic converter according to the this invention is a piezoelectric sheet preferably fabricated from polyvinylidene fluoride (such as that sold under the trademark KYNAR®, by Elf Atochem North America, Inc., of Philadelphia, Pa.) having first and second electrodes disposed on the middle portions of the opposite faces of the sheet. The first and second electrodes have electrically conductive terminals connected to conductive leads that provide an electrical input signal to the converter.

Electromagnetic tweeters, in contrast to the converter according to the present invention, accept low frequency electrical signals but are unable to convert these signals to sound. Instead, the energy associated with these signals is released in the form of heat, often causing damage. Therefore, conventional speaker systems require an active or passive electronic crossover circuit to divert low frequency signals away from the tweeter. Unlike conventional tweeters, the electro-acoustic converter according to the present invention has the natural ability to reject low frequencies. Therefore, because the speaker system uses a converter according to the present invention, it does not require an electronic crossover circuit.

The electrodes of the converter are preferably made from a dispersion of silver particles in polyurethane (such as that provided already disposed on the piezoelectric sheet by AMP, Inc., of Harrisburg, Pa.). The silver-polyurethane mixture is preferably provided in an ink-like form and screen printed onto both sides of the piezoelectric sheet. The high electrical conductivity of the ink ensures efficient electro-acoustic conversion at the high end of the audible spectrum. In fact, the efficiency is abnormally high. Although high efficiency operation is desirable, the transducer is overly responsive and must be partially dampened. The efficiency of the transducer is preferably reduced by the addition of a coating disposed preferably on at least one side of the transducer. The coating material is preferably polytetrafluoroethylene (such as that sold under the trademark TEFLON®, by E. I. du Pont de Nemours & Company, of Wilmington, Del.). The thickness and pattern of the coating on the transducer is preferably controlled, having a variety of effects. First, a thin coating over at least most of the electrode portion flattens the frequency response over a broad frequency range. Therefore, an idealized flat response is attainable by carefully controlling the pattern and thickness of the electrode coating.

In addition to flattening the frequency response of the transducer, the coating helps to minimize breakup distortion that accompanied known piezoelectric transducer operation. Although the mass of the preferred electrodes themselves provides a relatively effective dampening mechanism for the middle portion of the transducer, the coating provides additional control over other undesirable distortion effects. For example, because the electrodes do not extend to the edges of the transducer, the edges of the piezoelectric sheet tend to vibrate freely, resulting in a form of breakup distortion often referred to as "buzzing." In order to minimize this buzzing noise, the coating, unlike the electrode, is preferably disposed substantially more thickly along the longitudinal edges of the piezoelectric sheet. The application of the coating is preferably rubbed on to the desired thickness with a felt-tipped applicator.

The coating also stabilizes the performance of the transducer by stabilizing its capacitance. The capacitance of presently known piezoelectric transducers varied with changing atmospheric conditions. Since the transient response time of a piezoelectric transducer is known to depend on its capacitance, performance undesirably varied with changing atmospheric conditions. The transducer coating according to this invention stabilizes the capacitance and ensures consistent performance, regardless of the operational environment.

Yet another function of the coating is to protect the transducer electrodes from oxidation. Oxidation changes the conductive properties, as well as the surface mass density distribution of the transducer. Furthermore, the oxidation of the surface is aesthetically unpleasing and preferably avoided. All of these unwanted effects are substantially eliminated by the coating.

When a series of transient electrical signals is applied to the electrodes, a fluctuating electric field is produced in the sheet. The changing field causes a succession of in-plane contractions or elongations of the sheet. When the sheet is deformed out of its original planar shape, the in-plane motion produces an effective motion perpendicular to the sheet's surface. Preferably, when the transducer is used in a speaker, it is mounted around a hollow cylindrical body having an inner and outer surface, although any body that deforms the transducer out of its plane can be used. Preferably, the body is fabricated from a spun polypropylene material (such as that sold under the trademark HYTREX II®, by Osmonics, Inc., of Minnetonka, Minn.), and has a continuous variable mass density which decreases radially outwardly, such that the high density portion is located around the inner surface and the lowest density portion is located around the outer surface. The transducer is disposed against the flexible outer surface of the body. The flexibility of the outer surface ensures that the transducer can vibrate freely to produce sound, without being restricted. The dense inner surface serves to dampen inwardly directed back waves, preventing them from penetrating through the center and destructively interfering with the operation of the transducer on the opposing side. The continuously varying density also eliminates interfaces which could give rise to acoustic reflections.

Filling the hollow core with an acoustic dampening material further reduces the destructive interference between internally opposing portions of the transducer. In the preferred embodiment, ceramic fibers at least partially fill the hollow portion of the core, virtually eliminating the self-interference problem. The ceramic fibers are preferably alumina-silica ceramic fibers (such as those sold under the trademark KAOWOOL®, by Thermal Ceramics Inc., of Dunn, N.C.).

As previously mentioned, the outer surface of the body is preferably soft to allow unrestricted movement of the transducer. To further ensure that the transducer is not hampered during operation, the first and second edges of the transducer are preferably fastened together with an elastic adhesive strip which can flex during transducer operation. The strip is preferably a conventional double-sided pressure-sensitive adhesive tape with an elastic polymeric center having a thickness between about 0.03125 inch (about 0.0794 cm) and about 0.25 inch (about 0.635 cm), preferably about 0.0625 inch (about 0.1588 inch).

The preferred shape of the speaker system enclosure is ellipsoidal, and most preferably spherical. The spherical shape has several advantages. Perhaps the most important advantage is the relatively small number of resonant frequencies associated with a sphere that could otherwise absorb portions of the output. Additionally, the most likely spherical resonance, the radially symmetric one, is strongly discouraged by the inherent difficulty in stretching the entire sphere simultaneously.

Normally, the woofer is mounted so that its longitudinal axis is horizontal. In the preferred embodiment, the electro-acoustic converter is preferably mounted so that the longitudinal axis of the cylindrical converter is vertical, so that the sound produced radiates outward about the vertical axis. The converter preferably is also oriented so that the overlapping support strips of the transducer do not face in the same direction as the face of the woofer. Finally, an electro-acoustic converter cover, which preferably is acoustically transparent, is provided to protect the converter from physical damage and to improve its appearance. Preferably, the cover is made of aluminum foam (such as that sold under the trademark DUOCEL®, by Energy Research and Generation, Inc., of Oakland, Calif.), but a polymeric foam or other acoustically transparent material could also be used.

During operation of the acoustic speaker system, acoustic waves are produced at the back surface of the woofer. These backwaves must be dampened to minimize destructive interference effects. Ceramic fibers (such as those sold under the trademark KAOWOOL®, by Thermal Ceramics Inc., of Dunn, N.C.) preferably at least partially fill the woofer enclosure. These fibers are about four times more dense than conventional acoustic dampening materials. Due to the unusual dampening efficiency of the ceramic fibers, the size of the enclosure can be significantly reduced.

Although the spherical shape of the enclosure minimizes resonance effects, undesired residual effects can be further reduced if the enclosure is made from a relatively light-weight stiff material, such as polyethylene. A thin spherical shell of low or medium density polyethylene, therefore, provides a strong enclosure, while its light weight minimizes the absorption of acoustic energy and its subsequent conversion into heat.

Yet another way of minimizing acoustic absorption by the enclosure is to minimize the acoustic coupling between the speaker and the enclosure by introducing a specialized woofer mount which includes nylon rivets and a gasket. A conventional electromagnetic woofer normally has a frustoconic portion which vibrates during operation and a rigid support frame that attaches to the spherical enclosure. Normally, the woofer frame is securely fastened to the enclosure by screws or other metal fasteners. Unfortunately, however, the metallic fasteners efficiently transmit acoustic energy from the frame to the enclosure. Nylon rivets, however, substantially block the transmission of the acoustic energy much better than conventional metallic fasteners. Furthermore, an acoustically absorptive gasket is placed between the frame and the enclosure to further curb the transmission of acoustic energy from the woofer to the enclosure.

Furthermore, acoustic diffraction can undesirably alter the balanced frequency response of the speaker system. Diffraction, for example, can occur at the woofer frame. On traditional flat-faced enclosures, the flat woofer frame smoothly attaches to the flat outer surface of the enclosure. The spherical enclosure described in the present invention, however, does not smoothly accommodate the flat woofer frame. Therefore, to eliminate the diffraction that occurs at the frame-enclosure interface, the shape of the frame is curved to conform to the outer surface of the woofer enclosure.

Although the acoustic speaker system as described substantially prevents many of the adverse effects associated with system resonances, some of these effects persist. In order to eliminate the remaining undesirable effects, a dome-damper is preferably provided. The dome-damper is preferably an elastomeric cover fastened to a dome portion of a woofer. The size and shape of the dome-damper preferably can be customized to controllably dampen particular portions of the acoustic output. The dome-damper is preferably an elastomeric layer that is adhesively affixed to the dome portion.

A preferred embodiment of an acoustic speaker system according to the present invention, with several variations, is shown in FIGS. 1–13.

As can be seen in FIG. 1, acoustic speaker system 400 includes a woofer 450, a spherical woofer enclosure 410, an electro-acoustic converter 100 mounted on a portion of the outer surface 460 of the woofer enclosure 410, and an electro-acoustic converter cover 150.

In a first preferred variation (shown in FIGS. 2, 4 and 5), the converter 100 includes a rectangular transducer 10 which is mounted around a hollow cylindrical body 110 having an inner surface 120 and outer surface 130. In a second preferred variation, the converter 200 (shown in FIGS. 3, 4 and 6) includes a trapezoidal transducer 610 which is mounted around a hollow frustoconic body 210 having an inner surface 120 and an outer surface 130. The bodies 110, 210 are preferably fabricated from a spun polypropylene material, such as that described above; Each body 110, 210 has a variable mass density which decreases radially outwardly, such that the high density portion is located around the inner surface 120 and the low density portion is located around the outer surface 130. The dense inner surface 120 serves to dampen inwardly directed back waves produced by transducer 10 from penetrating through the hollow core 140 and destructively interfering with the operation of the transducer 10 on the opposite side of the body 110, while the low density outer surface 130 allows the vibration of transducer 10 necessary to create sound. As seen in a cross-sectional view of either preferred variation, shown in FIG. 4, ceramic fibers 160 preferably at least partially fill the hollow core 140 of the body 110, 210, substantially eliminating the self-interference problem.

FIGS. 5–8 show, in detail, two preferred variations of the electro-acoustic transducer used in converter 100, 200. The transducer 10, 610 preferably comprises a piezoelectric sheet 11, which is preferably (in the case of transducer 10) rectangular or (in the case of transducer 610) trapezoidal, having a first edge 12, a second opposing edge 13, two substantially parallel longitudinal edges 32, 33, a first face 14, and a second face 15. A first electrode 16 and second electrode 17 are disposed on the middle portions of the first face 14 and the second face 15 of sheet 11, respectively. A first support strip 18 is fastened to the second face 15 along the first edge 12 of the sheet 11 and a second support strip 19 is fastened to the first face 14 along the second edge 13 of sheet 11. The first electrode 16 has an extended portion 20 which extends toward the first edge 12 of the sheet 11 to which an electrically conductive terminal 21 is connected. Similarly, the second electrode 17 has an extended portion 22 which extends toward the second edge 10 of the sheet to which a second terminal 23 is connected. The terminals 21, 23 are preferably rivets, however any electrically conductive connecting element would suffice.

Electrodes 16, 17 are preferably fabricated from silver particles dispersed in polyurethane. The silver-polyurethane mixture is preferably provided in an ink-like form and is preferably screen printed onto both faces 14, 15 of the piezoelectric sheet 11. The thickness of the electrodes preferably is between about 2 microns and about 20 microns.

A first coating 30 is preferably disposed on the first electrode 16 and a second coating 31 is optionally disposed on the second electrode 17. Portions 34–37 of the coatings 30, 31 extend beyond the borders of the electrodes 16, 17 to the longitudinal edges 32, 33 of the sheet 11. By increasing the coating 30, 31 thickness at the longitudinal edges 32, 33 of the sheet 11, the coatings 30, 31 provide control over undesirable edge effects. For instance, because the electrodes 16, 17 do not extend to the longitudinal edges 32, 33 of the transducer 10, the edges 32, 33 vibrate freely, resulting in a form of breakup distortion often referred to as "buzzing." In order to minimize this buzzing noise, the coatings 30, 31, unlike the electrodes 16, 17, are extended to the longitudinal edges 32, 33 of the piezoelectric sheet 11, as discussed above. Longitudinal edge portions 34, 36 of first coating 30 are preferably substantially thicker than the portion disposed on the electrode 16. Longitudinal edge portions 35, 37 of the optional second coating 31 are also disposed substantially thicker then the portions disposed on the electrodes 16, 17. The thickness of the portions 34–37 of the coatings 30, 31 disposed along the longitudinal edges 32, 33 of the transducer 10 is preferably between about 8 microns and about 15 microns. The portions of the coatings 30, 31 which are disposed directly on the electrodes 16, 17 preferably have a thickness between about 1 micron and about 2 microns.

Figure 12:
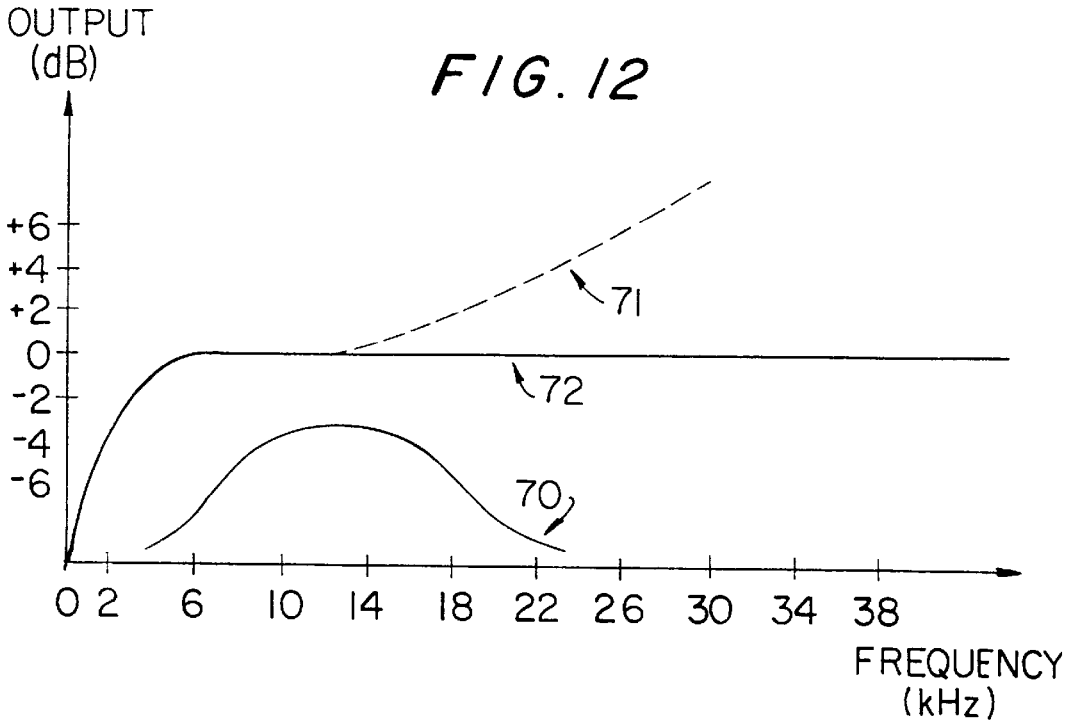
FIG. 12 is a plot demonstrating the output of a conventional tweeter, compared to the outputs of different embodiments of an electro-acoustic converter according to the present invention.

Coatings 30, 31, provide an effective dampening mechanism for the middle portion of each face. In FIG. 12, the output of the electro-acoustic converter, with and without the coatings, is compared to the output of a conventional converter. The output 70 of a conventional electro-acoustic converter normally begins to roll off above about 15 kHz. The highly conductive electrodes 16, 17 of this invention, however, have the desirable effect of drastically improving the high frequency response 71 of the converter 100. To accommodate the unusual efficiency displayed by converter 100 without the coatings 31, 32, the coatings 31, 32 are controllably applied to produce an ideal flat response 72.

The coatings 30, 31 also protect the electrodes 16, 17 from oxidation. Oxidation would change the conductive properties, as well as the mass surface density distribution of the transducer 10, thereby reducing the performance of the transducer 10. Furthermore, the oxidation of the silver dispersed in the electrodes 16, 17 would be aesthetically unpleasing and preferably avoided. All of these unwanted effects are substantially eliminated by the coating 31, 32.

Figure 9:
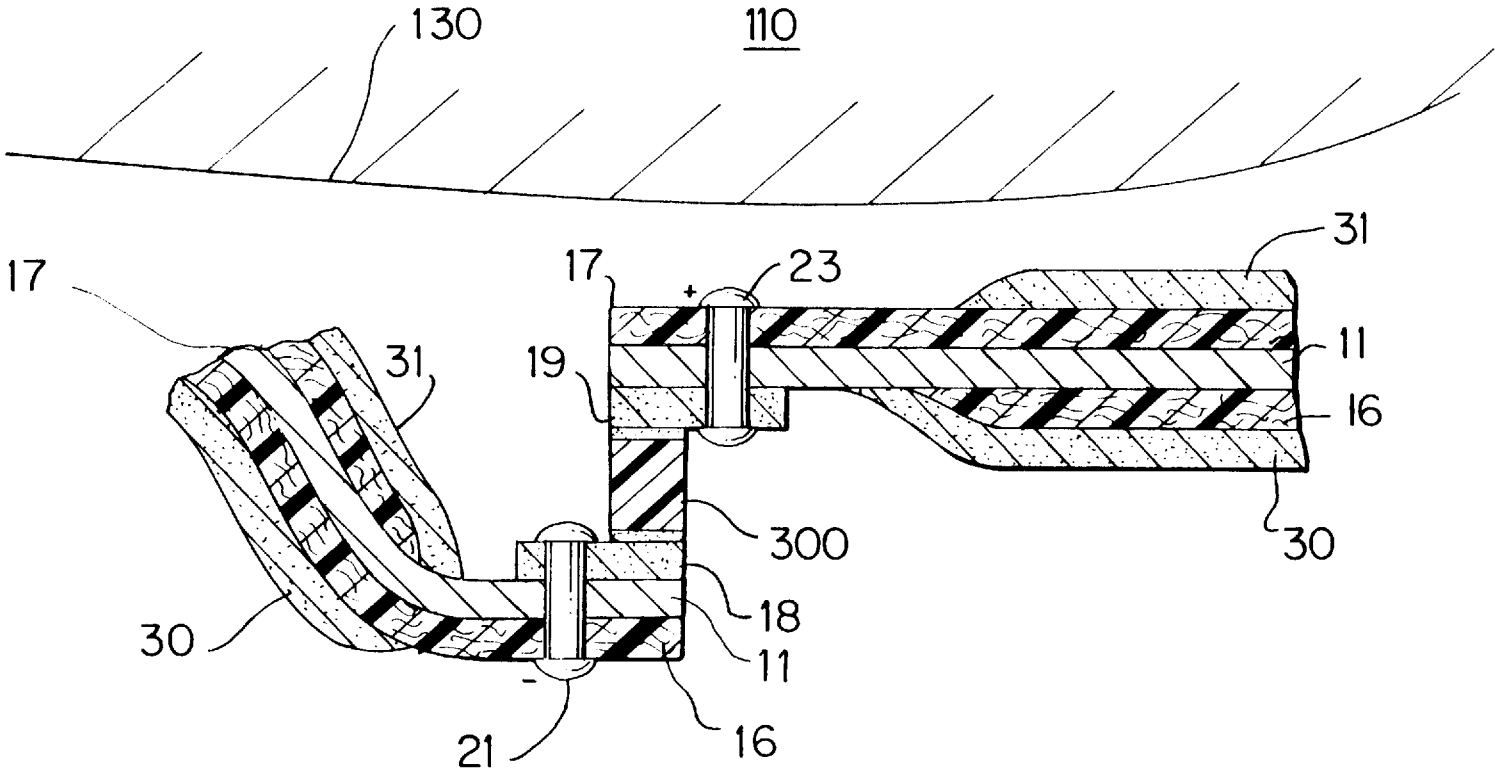
FIG. 9 is an enlarged cross-sectional view of a portion of the electro-acoustic converter of FIG. 2 or FIG. 3 taken from line 9—9 of FIG. 2 or FIG. 3.

As discussed above, the outer surface 130 of the body 110, 210 is preferably soft to allow unrestricted operation of the transducer 10, 610. To further ensure that the transducer 10, 610 is not hampered during operation, the first edge 12 and second edge 13 of the transducer 10, 610 are preferably fastened together with a flexible adhesive strip 300, as shown in FIG. 9. The strip 300 is preferably a conventional double-sided tape with an elastic polymeric core.

Figure 10:
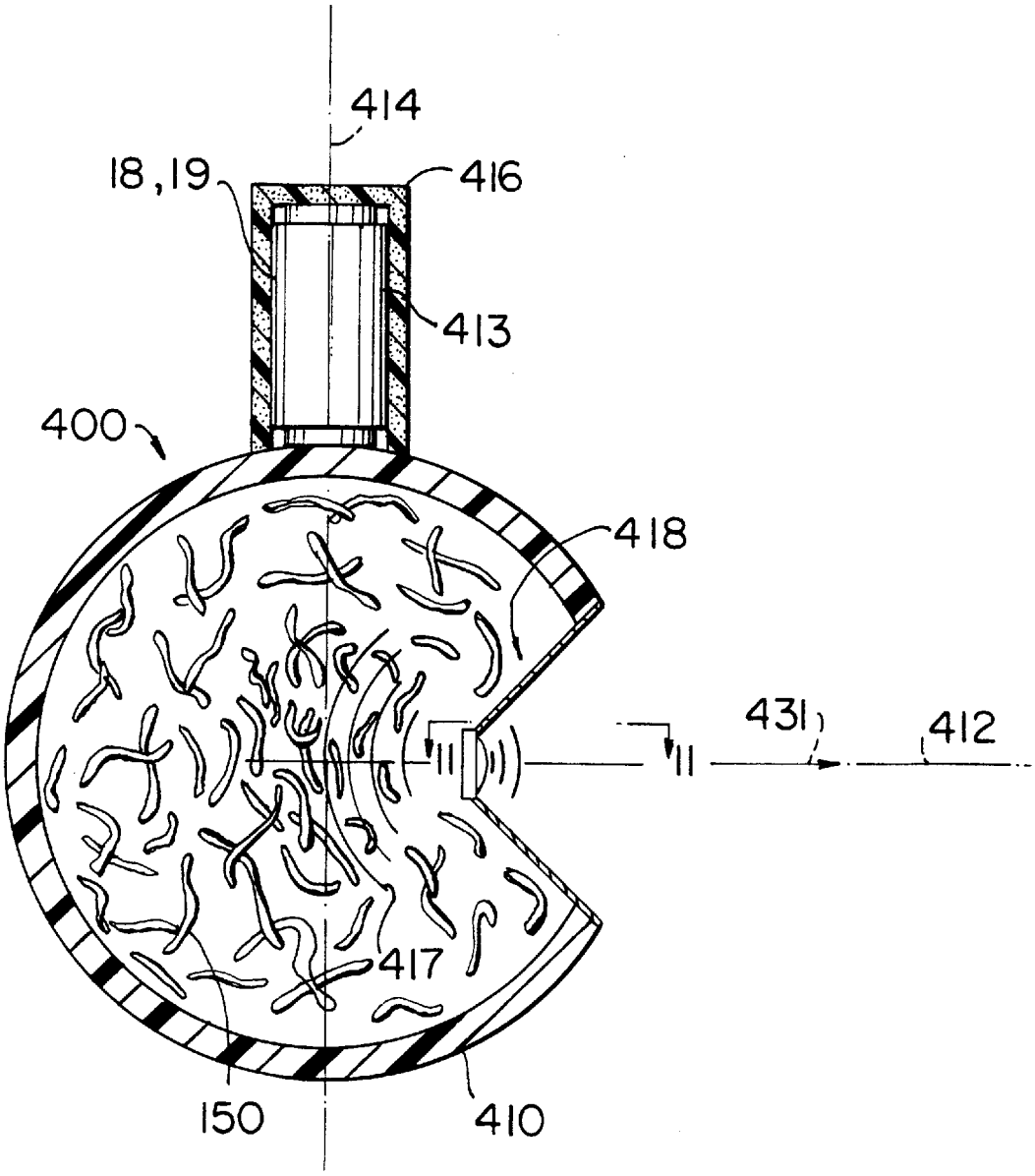
FIG. 10 is a vertical cross-sectional view of the acoustic speaker system of FIG. 1, taken from line 10—10 of FIG. 1.

As shown in FIG. 10, the speaker system 400 is normally oriented so that the longitudinal axis 412 of the woofer is horizontal. In the present invention, the tweeter 413 is preferably mounted so that its longitudinal axis 414 is vertical. The tweeter 413 is also oriented so that the overlapping first support strip 18 and second support strip 19 of the transducer 10, 610 do not face the same direction 431 as woofer 450. Finally, an electro-acoustic converter cover 416 is preferably provided to protect the tweeter and improve its appearance. As discussed above, converter cover 413 is preferably acoustically transparent and is preferably made from an aluminum foam (such as that sold under the trademark DUOCEL®, by Energy Research and Generation, Inc., of Oakland, Calif.). Conventional polymeric foams, or any other substantially acoustically transparent material, can also be used.

During operation of the speaker system 400, acoustic waves 417 are produced at the back surface 418 of the woofer 450. These backwaves 417 must be dampened to minimize destructive interference effects. As shown in FIG. 10, ceramic fibers 150 preferably at least partially fill the woofer enclosure 410. These fibers 150 are preferably alumina-silica ceramic fibers (such as those sold under the trademark KAOWOOL®, by Thermal Ceramics Inc., of Dunn, N.C.), which are about four times as dense than conventional acoustic dampening materials. Due to the unusual dampening efficiency of the ceramic fiber 150, a smaller quantity of material is required to absorb the backwaves 417 and the size of the enclosure can be significantly reduced.

The woofer enclosure 410 is made from a relatively lightweight stiff material, such as polyethylene, preferably having a thickness between about 0.0625 inch (about 0.1588 cm) and about 0.025 inch (about 0.635 cm). The thin spherical shell of low or medium density polyethylene 410 not only provides strength, its light weight minimizes the absorption of acoustic energy and its subsequent conversion into heat.

Figure 11:
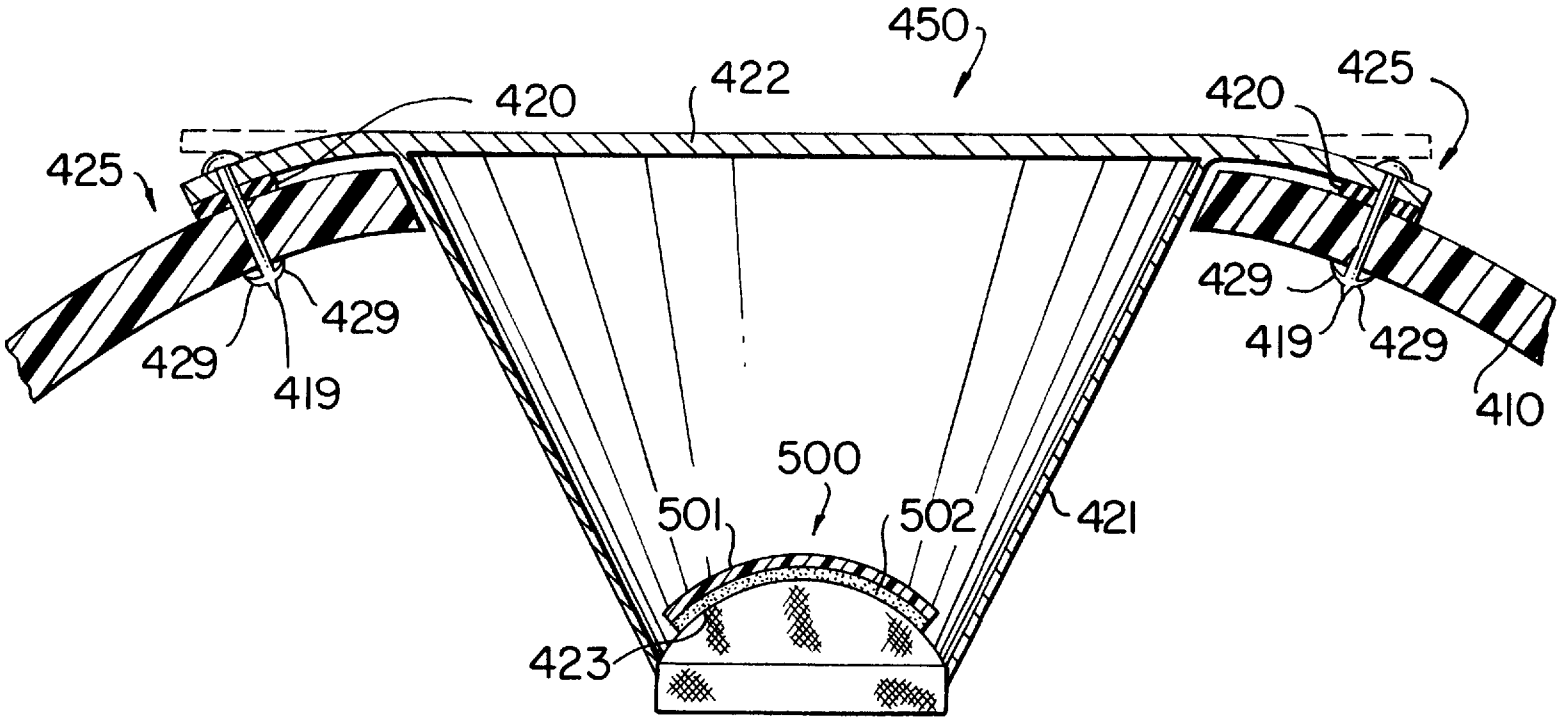
FIG. 11 is a horizontal cross-sectional view of the acoustic speaker system of FIGS. 1 and 10, taken from line 11—11 of FIGS. 1 and 10.

As shown in FIG. 11, acoustic absorption by the enclosure 410 is further minimized by reducing the acoustic coupling between the woofer 450 and the woofer enclosure 410 by introducing a specialized woofer mount which includes nylon rivets 419 (such as those sold under the trademark R-LOK®, available as part no. M-27-0396-02 from ITW Fastex Division, of Des Plaines, Ill.), having resilient arms 429 which provide a resilient grip, and a gasket 420 (made for example from MORTITE® strip sealant, available from Mortite, Inc., of Kankakee, Ill.). A conventional woofer 450 normally has a frustoconic portion 421 which vibrates during operation and a rigid support frame 422 that attaches to the enclosure 410. According to the present invention, the woofer frame 422 is preferably securely fastened to the outside of the woofer enclosure 410 by nylon rivets 419. Furthermore, an acoustically absorptive gasket 420 is placed between the frame and the enclosure to further curb the transmission of acoustic energy from the woofer 405 to the woofer enclosure 410. According to the present invention, the shape of the frame 422 is made to conform to the outer surface 424 of the woofer enclosure 410.

Figure 13:
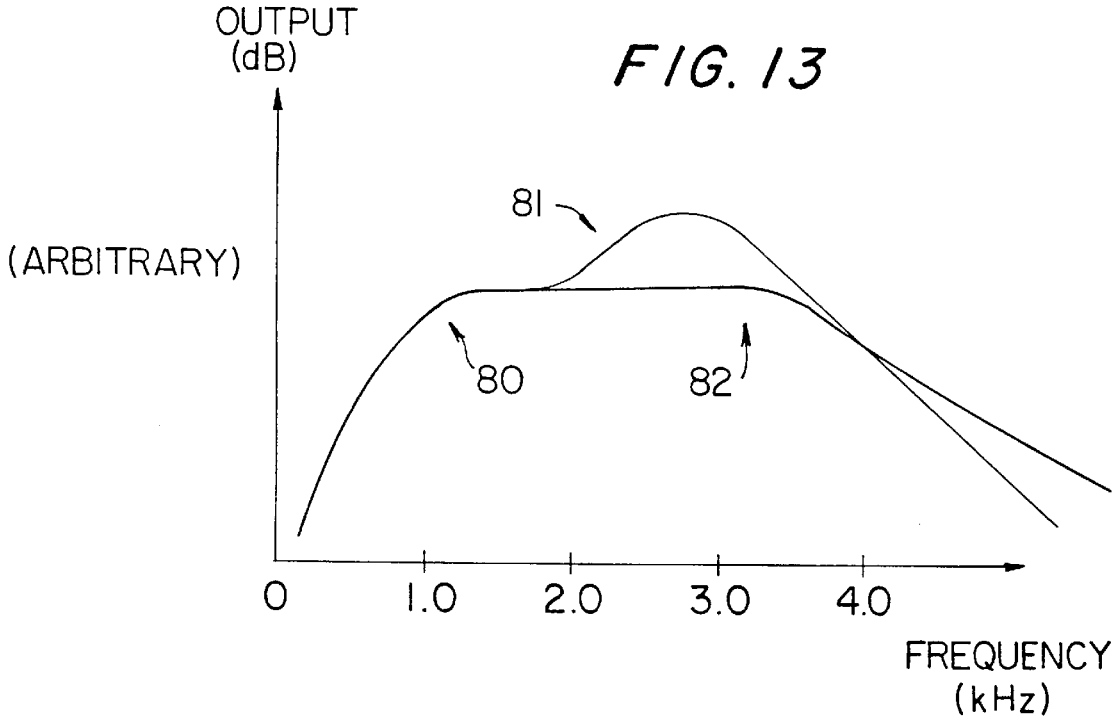
FIG. 13 is a plot demonstrating the natural output of a woofer compared to the modified output with a dome-damper according to the present invention installed.

As shown in FIG. 11, a dome-damper 500 is preferably provided to eliminate any residual undesirable resonant effects, such as cavitational resonances in the woofer voice coil assembly (not shown). Dome-damper 500 also improves mid-range dispersion. The dome-damper 500 is preferably an elastomeric cover fastened to a dome portion 423 of a woofer 450. Preferably the elastomeric layer 501 is made from a material such as that sold by the Ear Specialty Composites of Cabot Safety Corp., of Indianapolis, Ind., as part no. C2206-03PSA and is disposed on the dome portion 423 with a pressure sensitive adhesive layer 502. The effect of dome-damper 500 is illustrated in FIG. 13. A conventional woofer normally produces an asymmetric frequency response 80, having an undesirable bump 81 on the high end of its output. The addition of the dome-damper 500 eliminates the bump 81 and desirably flattens woofer response 82.

Thus it is seen that an acoustic speaker system that is provided that is physically small operates without a crossover network, and produces a broad balanced response over the entire audible spectrum with a fast transient response time. The system utilizes an electro-acoustic converter which distributes sound evenly over a broad angular range, virtually eliminates self-interference, and minimizes breakup distortion. One skilled in the art will appreciate that the present invention can be practiced by other than the described embodiments, which are presented for purposes of illustration and not of limitation, and the present invention is limited only by the claims which follow.

What is claimed is:

1. An electro-acoustic converter for converting between electrical and acoustic energy, said converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet; and a sound dampening body having an outer surface and a mass density that substantially continuously increases away from said outer surface; wherein:

said transducer is disposed against at least a portion of said outer surface of said body such that said sheet is deformed out of said plane.

2. The electro-acoustic converter of claim 1 wherein said sheet comprises a film of high molecular weight polymer having substantially uniformly oriented molecules.

3. The electro-acoustic converter of claim 2 wherein said high molecular weight polymer comprises polyvinylidene fluoride.

4. The electro-acoustic converter of claim 1 wherein said sheet has a thickness between about 9 microns and about 200 microns.

5. The electro-acoustic converter of claim 1 wherein said first and second layers partially dampen vibration of said sheet.

6. The electro-acoustic converter of claim 1 wherein each of said first and second layers comprises a flexible electrically conductive material.

7. The electro-acoustic converter of claim 1 wherein each of said first and second layers has edges disposed away from said edges of said sheet, thereby preventing arcing between said layers when an electric potential difference is applied across said layers.

8. The electro-acoustic converter of claim 1 wherein each of said first and second layers has a thickness between about 2 microns and about 20 microns.

9. The electro-acoustic converter of claim 1 wherein said sheet has a first hole adjacent to said first edge and a second hole adjacent to said second edge.

10. The electro-acoustic converter of claim 9 wherein said first layer has an extension which extends around said first hole in said sheet and said second layer has an extension which extends around said second hole in said sheet.

11. The electro-acoustic converter of claim 10 further comprising:

a first support strip secured along said first edge of said sheet and having a first support strip hole aligned with said first hole of said sheet; and a second support strip secured along said second edge of said sheet having a second support strip hole aligned with said second hole of said sheet.

12. The electro-acoustic converter of claim 11 wherein:

said sheet is wrapped around said body such that said first and second sheet edges meet; and said electro-acoustic converter further comprises a fastener for fastening together said first and second support strips.

13. The electro-acoustic converter of claim 12 wherein said fastener is a double-sided adhesive strip comprising a flexible material which stretches during electro-acoustic converter operation.

14. The electro-acoustic converter of claim 13 wherein said adhesive strip comprises a layer of flexible polymeric foam having adhesive layers on opposite sides thereof.

15. The electro-acoustic converter of claim 11 further comprising:

a first electrically conductive terminal secured in said first support strip hole in electrically conductive relationship with said first layer;

a first electrically conductive lead in electrically conductive relationship with said first terminal;

a second electrically conductive terminal secured in said second support strip hole in electrically conductive relationship with said second layer; and a second electrically conductive lead in electrically conductive relationship with said second terminal.

16. The electro-acoustic converter of claim 15 wherein each of said terminals comprises a rivet.

17. The electro-acoustic converter of claim 1 wherein said body is substantially rotationally symmetrical.

18. The electro-acoustic converter of claim 17 wherein said outer surface of said body has a shape selected from the group consisting of cone, cylinder, and frustocone.

19. The electro-acoustic converter of claim 18 wherein said body is a cylinder.

20. The electro-acoustic converter of claim 17 wherein said transducer is wrapped around said body.

21. The electro-acoustic converter of claim 1 wherein said transducer is in contact with said outer surface of said body.

22. The electro-acoustic converter of claim 1 wherein said body has a hollow inner core.

23. The electro-acoustic converter of claim 22 further comprising acoustic dampening material that at least partially fills said hollow inner core.

24. The electro-acoustic converter of claim 23 wherein said acoustic dampening material is fibrous.

25. The electro-acoustic converter of claim 24 wherein said acoustic dampening material comprises a fibrous ceramic material.

26. The electro-acoustic converter of claim 1 wherein said body comprises spun fibrous polypropylene.

27. An electro-acoustic converter for converting between electrical and acoustic energy, said converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet; and a body having an outer surface; wherein:

said transducer is disposed against at least a portion of said outer surface of said body such that said sheet is deformed out of said plane, and wherein each of said layers comprises silver dispersed in polyurethane.

28. The electro-acoustic converter of claim 27 further comprising at least a first transducer coating for at least one of (a) partially dampening vibration of said transducer and (b) retarding oxidation of said transducer, said first coating comprising:

a first portion which is disposed on said first conducting layer; and a second portion which is disposed on said first face of said sheet between said edges of said first conducting layer and said edges of said sheet.

29. The electro-acoustic converter of claim 28 wherein said first coating is electrically insulating.

30. The electro-acoustic converter of claim 28 wherein said first coating dampens the vibration of said transducer during converter operation, for equalizing frequency response and controlling breakup distortion.

31. The electro-acoustic converter of claim 28 wherein said first coating comprises polytetrafluoroethylene.

32. The electro-acoustic converter of claim 28 wherein said first portion of said first coating has a thickness between about 1 micron and about 2 microns.

33. The electro-acoustic converter of claim 28 wherein said second portion of said first coating has a thickness between about 8 microns and about 15 microns.

34. The electro-acoustic converter of claim 28 further comprising a second coating comprising:

a first portion which is disposed on said second conducting layer; and a second portion which is disposed on said second face of said sheet between said edges of said second conducting layer and said edges of said sheet.

35. The electro-acoustic converter of claim 34 wherein said second coating is electrically insulating.

36. The electro-acoustic converter of claim 34 wherein said second coating dampens the vibration of said transducer during converter operation, for equalizing frequency response and controlling breakup distortion.

37. The electro-acoustic converter of claim 34 wherein said second coating comprises polytetrafluoroethylene.

38. The electro-acoustic converter of claim 34 wherein said first portion of said second coating has a thickness between about 1 micron and about 2 microns.

39. The electro-acoustic converter of claim 34 wherein said second portion of said second coating has a thickness between about 8 microns and about 15 microns.

40. An acoustic speaker system comprising:

an electro-acoustic converter for converting between electrical and acoustic energy, said converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet; and a body having an outer surface; wherein:

said transducer is disposed against at least a portion of said outer surface of said body such that said sheet is deformed out of said plane, and wherein each of said layers comprises silver dispersed in polyurethane;

a woofer having a woofer frame;

a woofer enclosure having a woofer mounting hole and a tweeter mounting portion for mounting said electro-acoustic converter, said woofer mounting hole having an edge; and an acoustically opaque woofer mounting apparatus for minimizing acoustic absorption by said enclosure, said apparatus comprising:

a plurality of acoustically opaque resilient woofer fasteners for fastening a portion of said woofer frame to a portion of said woofer enclosure adjacent to said woofer mounting hole edge; and a substantially acoustically opaque gasket sandwiched between said woofer frame and said portion of said woofer enclosure adjacent to said woofer mounting hole edge.

41. The system enclosure of claim 40 wherein said fasteners are rivets.

42. The system enclosure of claim 41 wherein said rivets comprise a plastic material.

43. The acoustic speaker system of claim 40 further comprising:

a dome-damper for dampening predetermined portions of an audible frequency range comprising an elastomeric cover, said cover being fastened to a dome portion of said woofer having a dome shape, said cover being deformed to have substantially the same shape as said portion having a dome shape.

44. The dome-damper of claim 43 wherein said elastomeric cover is fastened by an adhesive fastener.

45. An acoustic speaker system comprising:

an electro-acoustic converter for converting between electrical and acoustic energy, said converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet; and a body having an outer surface; wherein:

said transducer is disposed against at least a portion of said outer surface of said body such that said sheet is deformed out of said plane, and wherein each of said layers comprises silver dispersed in polyurethane; and an electromagnetic acoustic speaker having a portion with a dome shape; and a dome-damper for dampening predetermined portions of an audible frequency range comprising an elastomeric cover that is fastened to said portion, said cover being deformed to have substantially the same shape as said portion having a dome shape.

46. The acoustic speaker of claim 45 wherein said elastomeric cover is fastened by an adhesive fastener.

47. An acoustic speaker system comprising:

an electro-acoustic converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet; and a sound dampening body having an outer surface and a mass density that substantially continuously increases away from said outer surface; wherein:

said transducer is disposed against at least a portion of said outer surface of said body such that said sheet is deformed out of said plane; said acoustic speaker system further comprising:

a woofer having a rigid substantially circular outer frame; and an acoustic system enclosure comprising a hollow woofer enclosure having:

a substantially ellipsoidal outer surface, said outer surface having a woofer mounting hole with an edge for mounting a woofer, and a mounting portion on said outer surface for mounting a tweeter.

48. The acoustic speaker system of claim 47 wherein said sheet comprises a film of high molecular weight polymer having substantially uniformly oriented molecules.

49. The acoustic speaker system of claim 48 wherein said high molecular weight polymer comprises polyvinylidene fluoride.

50. The acoustic speaker system of claim 47 wherein said sheet has a thickness between about 9 microns and about 200 microns.

51. The acoustic speaker system of claim 47 wherein said first and second layers partially dampen vibration of said sheet.

52. The acoustic speaker system of claim 47 wherein each of said first and second layers comprises a flexible electrically conductive material.

53. The acoustic speaker system of claim 47 wherein each of said first and second layers has edges disposed away from said edges of the sheet, thereby preventing arcing between said layers when an electric potential difference is applied across said layers.

54. The acoustic speaker system of claim 47 wherein each of said first and second layers has a thickness between about 2 microns and about 20 microns.

55. The acoustic speaker system of claim 47 wherein said sheet has a first hole adjacent to said first edge and a second hole adjacent to said second edge.

56. The acoustic speaker system of claim 55 wherein:

said first layer has an extension which extends around said first hole in said sheet; and said second layer has an extension which extends around said second hole in said sheet.

57. The acoustic speaker system of claim 56 further comprising:

a first support strip secured along said first edge of said sheet and having a first support strip hole aligned with said first hole of said sheet; and a second support strip secured along said second edge of said sheet having a second support strip hole aligned with said second hole of said sheet.

58. The acoustic speaker system of claim 57 wherein:

said sheet is wrapped around said body such that said first and second sheet edges meet; and said acoustic speaker system further comprising a fastener for fastening together said first and second support strips.

59. The acoustic speaker system of claim 58 wherein said fastener is a double-sided adhesive strip, comprising a flexible material which stretches during acoustic speaker system operation.

60. The acoustic speaker system of claim 59 wherein said adhesive strip comprises a layer of flexible polymeric foam having adhesive layers on opposite sides thereof.

61. The acoustic speaker system of claim 58 further comprising:

a first electrically conductive terminal being secured in said first support strip hole in electrically conductive relationship with said first layer;

a first electrically conductive lead in electrically conductive relationship with said first terminal;

a second electrically conductive terminal secured in said second support strip hole in electrically conductive relationship with said second layer; and a second electrically conductive lead in electrically conductive relationship with said second terminal.

62. The acoustic speaker system of claim 61 wherein each of said terminals comprises a rivet.

63. The acoustic speaker system of claim 47 wherein said body is substantially rotationally symmetrical.

64. The acoustic speaker system of claim 63 wherein said outer surface of said body has a shape selected from the group consisting of cone, cylinder, and frustocone.

65. The acoustic speaker system of claim 64 wherein said body is a cylinder.

66. The acoustic speaker system of claim 63 wherein said transducer is wrapped around said body.

67. The acoustic speaker system of claim 47 wherein said transducer is in contact with said outer surface of said body.

68. The acoustic speaker system of claim 47 wherein said body has a hollow inner core.

69. The acoustic speaker system of claim 68 further comprising acoustic dampening material that at least partially fills said hollow inner core.

70. The acoustic speaker system of claim 69 wherein said acoustic dampening material is fibrous.

71. The acoustic speaker system of claim 70 wherein said acoustic dampening material comprises a fibrous ceramic material.

72. The acoustic speaker system of claim 47 wherein said body comprises spun fibrous polypropylene.

73. The acoustic speaker system of claim 47 further comprising at least a first transducer coating for at least one of (a) partially dampening vibration of said transducer and (b) retarding oxidation of said transducer, said first coating comprising:

a first portion which is disposed on said first conducting layer; and a second portion which is disposed on said first face of said sheet between said edges of said first conducting layer and said edges of said sheet.

74. The acoustic speaker system of claim 73 wherein the first coating is electrically insulating.

75. The acoustic speaker system of claim 73 wherein said first coating dampens the vibration of said transducer during converter operation, for equalizing frequency response and controlling breakup distortion.

76. The acoustic speaker system of claim 73 wherein said first coating comprises polytetrafluoroethylene.

77. The acoustic speaker system of claim 73 wherein said first portion of said first coating has a thickness between about 1 micron and about 2 microns.

78. The acoustic speaker system of claim 73 wherein said second portion of said first coating has a thickness between about 8 microns and about 15 microns.

79. The acoustic speaker system of claim 73 further comprising a second coating comprising:

a first portion which is disposed on said second conducting layer; and a second portion which is disposed on said second face of said sheet between said edges of said second conducting layer and said edges of said sheet.

80. The acoustic speaker system of claim 79 wherein said second coating is electrically insulating.

81. The acoustic speaker system of claim 79 wherein said second coating dampens the vibration of said transducer during converter operation, for equalizing frequency response and controlling breakup distortion.

82. The acoustic speaker system of claim 79 wherein said second coating comprises polytetrafluoroethylene.

83. The acoustic speaker system of claim 79 wherein said first portion of said second coating has a thickness between about 1 micron and about 2 microns.

84. The acoustic speaker system of claim 79 wherein said second portion of said second coating has a thickness between about 8 microns and about 15 microns.

85. The acoustic speaker system of claim 47 wherein said substantially ellipsoidal outer surface is substantially spherical.

86. The acoustic speaker system of claim 47 further comprising a tweeter enclosure that is substantially acoustically transparent and at least partially encloses the tweeter.

87. The acoustic speaker system of claim 86 wherein the tweeter enclosure comprises a polymeric foam.

88. The acoustic speaker system of claim 86 wherein the tweeter enclosure comprises a metallic foam.

89. The acoustic speaker system of claim 88 wherein the metallic foam comprises aluminum.

90. The acoustic speaker system of claim 47 wherein said woofer enclosure comprises polyethylene.

91. The acoustic speaker system of claim 47 wherein said woofer enclosure has a wall thickness between about 0.0625 inch (about 0.1588 cm) and about 0.25 inch (about 0.635 cm).

92. The acoustic speaker system of claim 47 further comprising a woofer mount comprising:

a plurality of woofer fasteners for fastening a portion of said woofer frame to a portion of said woofer enclosure adjacent to said woofer mounting hole edge; and a substantially acoustically opaque gasket sandwiched between said woofer frame and said portion of said woofer enclosure adjacent to said hole edge.

93. The system enclosure of claim 92 wherein said woofer fasteners are rivets.

94. The system enclosure of claim 93 wherein said rivets comprise a plastic material.

95. The acoustic speaker system of claim 47 further comprising an acoustic dampening material inside said woofer enclosure.

96. The acoustic speaker system of claim 85 wherein said acoustic dampening material comprises fibrous ceramic material.

97. The acoustic speaker system of claim 47 further comprising a dome-damper for dampening predetermined portions of an audible frequency range comprising an elastomeric cover fastened to a dome portion of the woofer.

98. The acoustic speaker system of claim 97 wherein said elastomeric cover is fastened by an adhesive fastener.

99. The acoustic speaker system of claim 47 wherein the woofer frame smoothly conforms to the outer surface of the woofer enclosure.

100. An acoustic speaker system comprising:

an electro-acoustic converter comprising:

an electro-acoustic transducer comprising:

a flexible piezoelectric sheet defining a plane, and having a first edge, a second edge opposed to said first edge, a first face, and a second face opposite said first face, an electrically conducting first layer disposed on said first face of the sheet, and an electrically conducting second layer disposed on the second face of said sheet, wherein at least one of said conducting layers comprises silver dispersed in polyurethane; and a body having an outer surface; wherein:

said transducer is disposed against at least a portion of said outer surface of said body such that said sheet is deformed out of said plane; said acoustic speaker system further comprising:

a woofer having a rigid substantially circular outer frame; and an acoustic system enclosure comprising a hollow woofer enclosure having:

a substantially ellipsoidal outer surface, said outer surface having a woofer mounting hole with an edge for mounting a woofer, and a mounting portion on said outer surface for mounting a tweeter.

101. An electro-acoustic converter for converting between electrical and acoustic energy, said converter comprising:

an electro-acoustic transducer comprising:

a flexible piezoelectric sheet having a first edge, a second edge opposed to said first edge, a first face, and a second face opposite said first face, said sheet being deformed into a non-planar shape, an electrically conducting first layer disposed on said first face of the sheet, said first layer having edges disposed away from said first edge of said sheet, and an electrically conducting second layer disposed on the second face of said sheet; and a first transducer coating for at least one of (a) partially dampening vibration of said transducer and (b) retarding oxidation of said transducer, said first coating comprising:

a first portion which is disposed on said first conducting layer; and a second portion which is disposed on said first face of said sheet between said edges of said first conducting layer and said edges of said sheet.

102. The electro-acoustic converter of claim 101 wherein said first coating is electrically insulating.

103. The electro-acoustic converter of claim 101 wherein said first coating dampens the vibration of said transducer during converter operation, for equalizing frequency response and controlling breakup distortion.

104. The electro-acoustic converter of claim 101 wherein said first coating comprises polytetrafluoroethylene.

105. The electro-acoustic converter of claim 101 wherein said first portion of said first coating has a thickness between about 1 micron and about 2 microns.

106. The electro-acoustic converter of claim 101 wherein said second portion of said first coating has a thickness between about 8 microns and about 15 microns.

107. The electro-acoustic converter of claim 101 further comprising a second coating comprising:

a first portion which is disposed on said second conducting layer; and a second portion which is disposed on said second face of said sheet between said edges of said second conducting layer and said edges of said sheet.

108. The electro-acoustic converter of claim 107 wherein said second coating is electrically insulating.

109. The electro-acoustic converter of claim 107 wherein said second coating dampens the vibration of said transducer during converter operation, for equalizing frequency response and controlling breakup distortion.

110. The electro-acoustic converter of claim 107 wherein said second coating comprises polytetrafluoroethylene.

111. The electro-acoustic converter of claim 107 wherein said first portion of said second coating has a thickness between about 1 micron and about 2 microns.

112. The electro-acoustic converter of claim 107 wherein said second portion of said second coating has a thickness between about 8 microns and about 15 microns.

113. The electro-acoustic converter of claim 101 wherein said sheet comprises a film of high molecular weight polymer having substantially uniformly oriented molecules.

114. The electro-acoustic converter of claim 113 wherein said high molecular weight polymer comprises polyvinylidene fluoride.

115. The electro-acoustic converter of claim 101 wherein said sheet has a thickness between about 9 microns and about 200 microns.

116. The electro-acoustic converter of claim 101 wherein said first and second layers partially dampen vibration of said sheet.

117. The electro-acoustic converter of claim 101 wherein each of said first and second layers comprises a flexible electrically conductive material.

118. The electro-acoustic converter of claim 117 wherein each of said flexible electrically conductive layers comprises silver dispersed in polyurethane.

119. The electro-acoustic converter of claim 101 wherein each of said first and second layers has edges disposed away from said edges of said sheet, thereby preventing arcing between said layers when an electric potential difference is applied across said layers.

120. The electro-acoustic converter of claim 101 wherein each of said first and second layers has a thickness between about 2 microns and about 20 microns.

121. The electro-acoustic converter of claim 101 wherein said sheet has a first hole adjacent to said first edge and a second hole adjacent to said second edge.

122. The electro-acoustic converter of claim 121 wherein said first layer has an extension which extends around said first hole in said sheet and said second layer has an extension which extends around said second hole in said sheet.

123. The electro-acoustic converter of claim 122 further comprising:

a first support strip secured along said first edge of said sheet and having a first support strip hole aligned with said first hole of said sheet; and a second support strip secured along said second edge of said sheet having a second support strip hole aligned with said second hole of said sheet.

124. The electro-acoustic converter of claim 123 wherein:

said sheet is wrapped around said body such that said first and second sheet edges meet; and said electro-acoustic converter further comprises a fastener for fastening together said first and second support strips.

125. The electro-acoustic converter of claim 124 wherein said fastener is a double-sided adhesive strip comprising a flexible material which stretches during electro-acoustic converter operation.

126. The electro-acoustic converter of claim 125 wherein said adhesive strip comprises a layer of flexible polymeric foam having adhesive layers on opposite sides thereof.

127. The electro-acoustic converter of claim 123 further comprising:

a first electrically conductive terminal secured in said first support strip hole in electrically conductive relationship with said first layer;

a first electrically conductive lead in electrically conductive relationship with said first terminal;

a second electrically conductive terminal secured in said second support strip hole in electrically conductive relationship with said second layer; and a second electrically conductive lead in electrically conductive relationship with said second terminal.

128. The electro-acoustic converter of claim 127 wherein each of said terminals comprises a rivet.

129. An acoustic speaker system comprising:

an electro-acoustic converter comprising:

an electro-acoustic transducer comprising:

a flexible piezoelectric sheet defining a plane, and having a first edge, a second edge opposed to said first edge, a first face, and a second face opposite said first face, said sheet being deformed into a non-planar shape, an electrically conducting first layer disposed on said first face of the sheet, said first layer having edges disposed away from said edges of said sheet, and an electrically conducting second layer disposed on the second face of said sheet, wherein at least one of said electrically conducting layers comprises silver dispersed in polyurethane; and a first transducer coating for at least one of (a) partially dampening vibration of said transducer and (b) retarding oxidation of said transducer, said first coating comprising:

a first portion which is disposed on said first conducting layer; and a second portion which is disposed on said first face of said sheet between said edges of said first conducting layer and said edges of said sheet; wherein:

said sheet is deformed out of said plane; said acoustic speaker system further comprising:

a woofer having a rigid substantially circular outer frame; and an acoustic system enclosure comprising a hollow woofer enclosure having:

a substantially ellipsoidal outer surface, said outer surface having a woofer mounting hole with an edge for mounting a woofer, and a mounting portion on said outer surface for mounting a tweeter.

130. The acoustic speaker system of claim 129 wherein the first coating is electrically insulating.

131. The acoustic speaker system of claim 129 wherein said first coating dampens the vibration of said transducer during converter operation, for equalizing frequency response and controlling breakup distortion.

132. The acoustic speaker system of claim 129 wherein said first coating comprises polytetrafluoroethylene.

133. The acoustic speaker system of claim 129 wherein said first portion of said first coating has a thickness between about 1 micron and about 2 microns.

134. The acoustic speaker system of claim 129 wherein said second portion of said first coating has a thickness between about 8 microns and about 15 microns.

135. The acoustic speaker system of claim 129 further comprising a second coating comprising:

a first portion which is disposed on said second conducting layer; and a second portion which is disposed on said second face of said sheet between said edges of said second conducting layer and said edges of said sheet.

136. The acoustic speaker system of claim 135 wherein said second coating is electrically insulating.

137. The acoustic speaker system of claim 135 wherein said second coating dampens the vibration of said transducer during converter operation, for equalizing frequency response and controlling breakup distortion.

138. The acoustic speaker system of claim 135 wherein said second coating comprises polytetrafluoroethylene.

139. The acoustic speaker system of claim 135 wherein said first portion of said second coating has a thickness between about 1 micron and about 2 microns.

140. The acoustic speaker system of claim 135 wherein said second portion of said second coating has a thickness between about 8 microns and about 15 microns.

141. The acoustic speaker system of claim 140 wherein said sheet comprises a film of high molecular weight polymer having substantially uniformly oriented molecules.

142. The acoustic speaker system of claim 141 wherein said high molecular weight polymer comprises polyvinylidene fluoride.

143. The acoustic speaker system of claim 141 wherein said sheet has a thickness between about 9 microns and about 200 microns.

144. The acoustic speaker system of claim 141 wherein said first and second layers partially dampen vibration of said sheet.

145. The acoustic speaker system of claim 141 wherein each of said first and second layers comprises a flexible electrically conductive material.

146. The acoustic speaker system of claim 140 wherein each of said first and second layers has edges disposed away from said edges of the sheet, thereby preventing arcing between said layers when an electric potential difference is applied across said layers.

147. The acoustic speaker system of claim 140 wherein each of said first and second layers has a thickness between about 2 microns and about 20 microns.

148. The acoustic speaker system of claim 140 wherein said sheet has a first hole adjacent to said first edge and a second hole adjacent to said second edge.

149. The acoustic speaker system of claim 148 wherein:

said first layer has an extension which extends around said first hole in said sheet; and said second layer has an extension which extends around said second hole in said sheet.

150. The acoustic speaker system of claim 149 further comprising:

a first support strip secured along said first edge of said sheet and having a first support strip hole aligned with said first hole of said sheet; and a second support strip secured along said second edge of said sheet having a second support strip hole aligned with said second hole of said sheet.

151. The acoustic speaker system of claim 150 wherein:

said sheet is wrapped around said body such that said first and second sheet edges meet; and said acoustic speaker system further comprising a fastener for fastening together said first and second support strips.

152. The acoustic speaker system of claim 151 wherein said fastener is a double-sided adhesive strip, comprising a flexible material which stretches during acoustic speaker system operation.

153. The acoustic speaker system of claim 152 wherein said adhesive strip comprises a layer of flexible polymeric foam having adhesive layers on opposite sides thereof.

154. The acoustic speaker system of claim 151 further comprising:

a first electrically conductive terminal being secured in said first support strip hole in electrically conductive relationship with said first layer;

a first electrically conductive lead in electrically conductive relationship with said first terminal;

a second electrically conductive terminal secured in said second support strip hole in electrically conductive relationship with said second layer; and a second electrically conductive lead in electrically conductive relationship with said second terminal.

155. The acoustic speaker system of claim 154 wherein each of said terminals comprises a rivet.

156. The acoustic speaker system of claim 129 wherein said substantially ellipsoidal outer surface is substantially spherical.

157. The acoustic speaker system of claim 129 further comprising a tweeter enclosure that is substantially acoustically transparent and at least partially encloses the tweeter.

158. The acoustic speaker system of claim 157 wherein the tweeter enclosure comprises a polymeric foam.

159. The acoustic speaker system of claim 157 wherein the tweeter enclosure comprises a metallic foam.

160. The acoustic speaker system of claim 159 wherein the metallic foam comprises aluminum.

161. The acoustic speaker system of claim 129 wherein said woofer enclosure comprises polyethylene.

162. The acoustic speaker system of claim 129 wherein said woofer enclosure has a wall thickness between about 0.0625 inch (about 0.1588 cm) and about 0.25 inch (about 0.635 cm).

163. The acoustic speaker system of claim 129 further comprising a woofer mount comprising:

a plurality of woofer fasteners for fastening a portion of said woofer frame to a portion of said woofer enclosure adjacent to said woofer mounting hole edge; and a substantially acoustically opaque gasket sandwiched between said woofer frame and said portion of said woofer enclosure adjacent to said hole edge.

164. The system enclosure of claim 163 wherein said woofer fasteners are rivets.

165. The system enclosure of claim 164 wherein said rivets comprise a plastic material.

166. The acoustic speaker system of claim 129 further comprising an acoustic dampening material inside said woofer enclosure.

167. The acoustic speaker system of claim 166 wherein said acoustic dampening material comprises fibrous ceramic material.

168. The acoustic speaker system of claim 129 further comprising a dome-damper for dampening predetermined portions of an audible frequency range comprising an elastomeric cover fastened to a dome portion of the woofer.

169. The acoustic speaker system of claim 168 wherein said elastomeric cover is fastened by an adhesive fastener.

170. The acoustic speaker system of claim 129 wherein the woofer frame smoothly conforms to the outer surface of the woofer enclosure.

* * * * *

UNITED STATES PATENT AND TRADEMARK OFFICE

CERTIFICATE OF CORRECTION

PATENT NO. : 5,828,766

DATED : October 27, 1998

INVENTOR(S) : Anthony Gallo

It is certified that error appears in the above-indentified patent and that said Letters Patent is hereby corrected as shown below:

Column 9, line 7, "above;" should be --above--.
Column 14, line 56, delete "enclosure".
Column 14, line 58, delete "enclosure".
Column 18, line 23, "141" should be --140--.
Column 21, line 59, "141" should be --140--.
Column 21, line 62, "141" should be --140--.
Column 21, line 65, "141" should be --140--.

Signed and Sealed this

Twenty-eighth Day of November, 2000

*Attest:*

Q. TODD DICKINSON

*Attesting Officer*

*Director of Patents and Trademarks*